US005400754A

United States Patent [19]

Blanco Palacios et al.

[11] Patent Number: 5,400,754

[45] Date of Patent: Mar. 28, 1995

[54] ROTARY INTERNAL COMBUSTION ENGINE WITH PADDLE AND RATCHET ASSEMBLY

[76] Inventors: Alberto F. Blanco Palacios; J. Fernando Blanco Palacios, both of Av. Bartolome de las Casas 482, Urb. Los Jazmines - Surco, Lima 33, Peru

[21] Appl. No.: 109,317

[22] Filed: Aug. 19, 1993

[51] Int. Cl.[6] ..... F02B 53/00

[52] U.S. Cl. ..... 123/245; 418/36

[58] Field of Search ..... 418/33, 35, 36; 123/245

[56] References Cited

U.S. PATENT DOCUMENTS

| | | | |
|---|---|---|---|
| 719,969 | 2/1903 | Wood . | |
| 859,959 | 7/1907 | Marsh . | |
| 957,631 | 5/1910 | Stewart . | |
| 1,013,139 | 1/1912 | Dittlinger . | |
| 1,305,966 | 6/1919 | Green . | |
| 1,367,591 | 2/1921 | Duncombe . | |
| 2,071,528 | 2/1937 | Hover | 123/11 |
| 2,731,000 | 1/1956 | Pelhat | 123/11 |
| 2,804,059 | 8/1957 | Honjyo | 123/11 |
| 2,816,527 | 12/1957 | Palazzo | 123/11 |
| 3,136,303 | 6/1964 | Ievens | 123/11 |
| 4,137,891 | 2/1979 | Dalrymple | 123/245 |
| 4,744,736 | 5/1988 | Stauffer | 418/35 |
| 5,199,391 | 4/1993 | Kovalenko | 418/35 |

FOREIGN PATENT DOCUMENTS

| | | | |
|---|---|---|---|
| 1232505 | 4/1959 | France | 123/245 |
| 0000249 | of 1873 | United Kingdom | 418/35 |

OTHER PUBLICATIONS

"Round Two" *Popular Mechanics,* Jun., 1962, pp. 88 to 91.

"Vane Pump Rotary Engine" *Popular Mechanics* Jun., 1962, p. 97.

"el motor rotatorio, un invento peruana" Ruedas & Tuercos, Servicios Especiales de Edicion S.A., Lima, Peru (May 5, 1993) pp. 28–29.

*Primary Examiner*—Richard A. Bertsch
*Assistant Examiner*—Charles G. Freay
*Attorney, Agent, or Firm*—Ladas & Parry

[57] ABSTRACT

A rotary internal combustion engine, has an engine block defining a drum-shaped combustion chamber. A rotatable propeller shaft extends axially through the chamber. First and second paddle and hub devices are freely rotating on the propeller shaft at least substantially sealingly in the chamber, each of the paddle and hub devices having first and second paddles that are fixed diametrically opposite each other with a hub therebetween. The hubs cooperate with each other so that the first paddle and hub device can also rotate relative to the second paddle and hub device, the hubs of the first and second paddle and hub means having end portions respectively extending from axially opposite ends of the chamber. Each of first and second gear trains has (A) a first ratchet for rotationally connecting a respective one of the hubs to the propeller shaft in a first rotational direction and disconnecting the one of the hubs from the propeller shaft in a second, opposite rotational direction and (B) a second ratchet with a gear reduction for reducing rotational speed relative to the rotational connection of the first ratchet and rotationally connecting the propeller shaft to the one of the hubs in the first rotational direction with the reduced rotational speed and disconnecting the propeller shaft from the one of the hubs in the second rotational direction. An inlet in a first quadrant of the chamber admits air into the chamber. A nozzle admits fuel into a third quadrant of the chamber An outlet in a fourth quadrant of the chamber exhausts.

20 Claims, 13 Drawing Sheets

ROTARY INTERNAL COMBUSTION ENGINE WITH PADDLE AND RATCHET ASSEMBLY

BACKGROUND OF THE INVENTION

The invention relates to a rotary internal combustion engine.

Currently, the most widely used internal combustion engines have cylinders with reciprocating pistons operating in Otto or Diesel cycles. The pistons reciprocate linearly within cylinders, alternately changing directions of movement at the end of each stroke.

This type of engine generally requires four strokes of the piston to complete one full combustion cycle. In each of those strokes, the piston changes its linear course and actually stops and starts again, every time, losing its momentum in each of the four times this happens in just one combustion cycle. Further, the linear movement of the piston has to be changed to rotational movement via a crankshaft and the power transmission of this is sinusoidal and passes through zero (no power transmission) when the crank and piston connecting rod are aligned at two opposite dead points in each rotation of the crankshaft. Furthermore, the crank lever arm is necessarily short in order to keep the stroke length short, whereby the torque produced is low. As a consequence, the efficiency or performance of these engines is very poor and the operational costs and pollution are excessive.

These technical limitations were the main reasons that led to the development of rotary engines. Currently, however, only the Wankel engine has achieved some commercial success.

The reason for this is because the piston, or rotor in this case, although it does not stop, does not produce sufficient power, either, because of its very short lever arm and low admission capacity. This deficiency is partially overcome by using two rotors with turbocharged admission and high-speed revolutions that, however, cause excessive wear to the engine and increase fuel consumption to the extent that it becomes uneconomic and over-polluting for any use other than in sports cars, and is not used for family cars.

SUMMARY OF THE INVENTION

The object of the invention is, therefore, a rotary internal combustion engine of an entirely different conception and working principle for more efficiency, less expense, less pollution, simpler construction and many other advantages in relation to other engines.

A preferred embodiment fully delivers the energy of four explosions per revolution of the rotor, making the drive-shaft rotate almost two revolutions. Extremely high power output is achieved at very low rotation speeds due to its very long lever arm, which makes the same amount of fuel as used in an ordinary, reciprocating piston engine, produce almost five times more torsion, i.e. 80% energy and pollution reduction for the same torque. There is almost no vibration. Valves, camshaft, crankshaft, distributor, turbocharger, etc. are eliminated.

Although the elements themselves are not new, the novelty is the arrangement of these elements and the overall conception of the working principle, particularly the functioning of the two ratchets and gear reductions for each paddle.

This type of engine WILL NEVER WORK if the hub of each paddle does not jut out INDEPENDENTLY, one to one end and the other to the opposite end of the engine. As no other previous patent shows this, then it becomes a distinctive characteristic of the present invention. Moreover, these hubs allow a direct connection to the ratchets, e.g. intermediate masses, which, in fact, becomes an extension, outside of the combustion chamber of the paddles themselves.

Each paddle requires AT LEAST TWO RATCHETS, which is something that previous patents don't show. In our invention, and only for an easier and obvious understanding, we are presenting these two ratchets as being concentric, separated by the intermediate mass, and having a peripheral gear in the periphery of the second ratchet, to engage with the gear reductions.

The first, e.g. inner ratchet, is needed to catch (engage) the drive shaft and transmit the drive force, coming from a "fast" paddle, onto the drive shaft, and let go (disengage) when the fast paddle becomes a "slow" paddle. This is the only ratchet that previous patents show.

The second ratchet, e.g. outer ratchet, which is not shown by previous patents, and which is an essential part of the engine, is needed to catch (engage) the slow paddle and prevent it from rotation backwards at the time the explosion takes place; and let go (disengage) when the slow paddle becomes a fast paddle.

A GEAR TRAIN associated with the second, e.g. outer ratchet, is also an essential part of the engine, because the slow paddle inevitably needs to be transported, a few degrees, to reach the ignition point. This requires a gear reduction in the gear train from the fast paddle, through the drive shaft, to the slow paddle, which is also an essential part of the engine.

This advancement mechanism (opposite-end hubs, ratchets and gear train) in direct connection between the drive and propeller shaft is clearly distinctive from previous patents. It is also the main reason why this engine really works whilst the others don't, and never will.

BRIEF DESCRIPTION OF THE DRAWINGS

Preferred embodiments, that illustrate but do not limit the invention, will now be described with reference to drawings, wherein.

DESCRIPTION OF PREFERRED EMBODIMENTS FOR ILLUSTRATION PURPOSES

BASIC INTERNAL ELEMENTS (inside combustion chamber)

Figure 2:
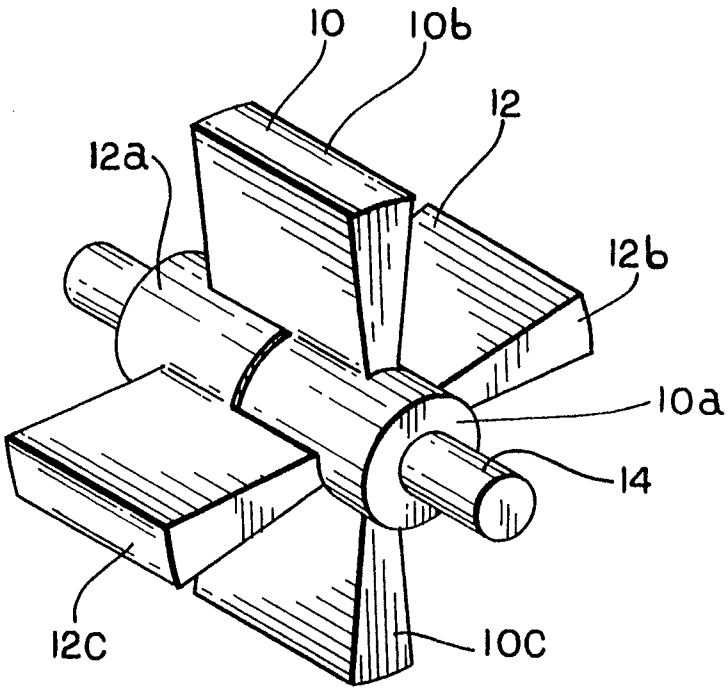
FIG. 2 is a top/front/left side perspective view of two intercrossing paddle devices, with an axial shaft through their hubs, of internal elements that go inside the engine block combustion chamber.
Figure 1:
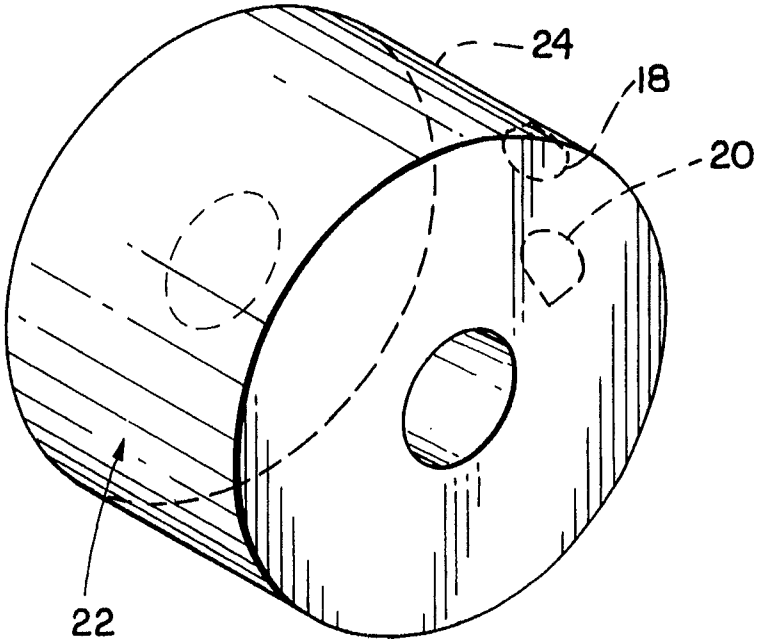
FIG. 1 is a top/front/left side perspective view of a drum-shaped engine block combustion chamber having an inlet and an outlet opening and an ignition point.

The basic internal elements are shown in FIGS. 1 and 2 as the following:

- Two intercrossing paddle, impeller, or propeller devices 10, 12. Each paddle device has a hub 10*a*, 12*a* with first and second diametrically opposite, co-extensive paddles 10*b*, 10*c*; 12*b* and 12*c*.
- One common axis-defining drive shaft 14 (cf. a crankshaft) from which the output power of the engine can be taken in a known way (not shown) from either or both opposite ends.
- One drum-shaped (i.e., cylindrical) metallic case or engine block combustion chamber 24 with one inlet opening 18, one outlet opening 20 and one ignition point 22. (The ignition point 22 is a location where there may be one or more nozzles and/or an ignition device.)

The two intercrossing paddle devices are freely rotatable on the common drive shaft. They are also freely rotatable inside a drum-shaped cylinder or combustion chamber 24 (FIGS. 4 and 5) of the engine block which contains them exactly, i.e. sealingly, but allows their precise rotation. Appropriate seals (not shown) may facilitate the sealing. The cylinder portion of the engine block is thus divided internally into four variable quadrants or compartments. The inlet opening is in the first quadrant, the outlet opening is in the fourth quadrant and the ignition point is in the third quadrant (FIG. 3A).

Inside the cylinder portion of the engine block, the four stages (cf. strokes) of the internal combustion cycle take place simultaneously due to the relative rotating interaction of the paddle devices which, via external elements described below, transmit their rotary movement to the drive shaft.

BASIC EXTERNAL ELEMENTS (outside the combustion chamber)

Figure 3A:
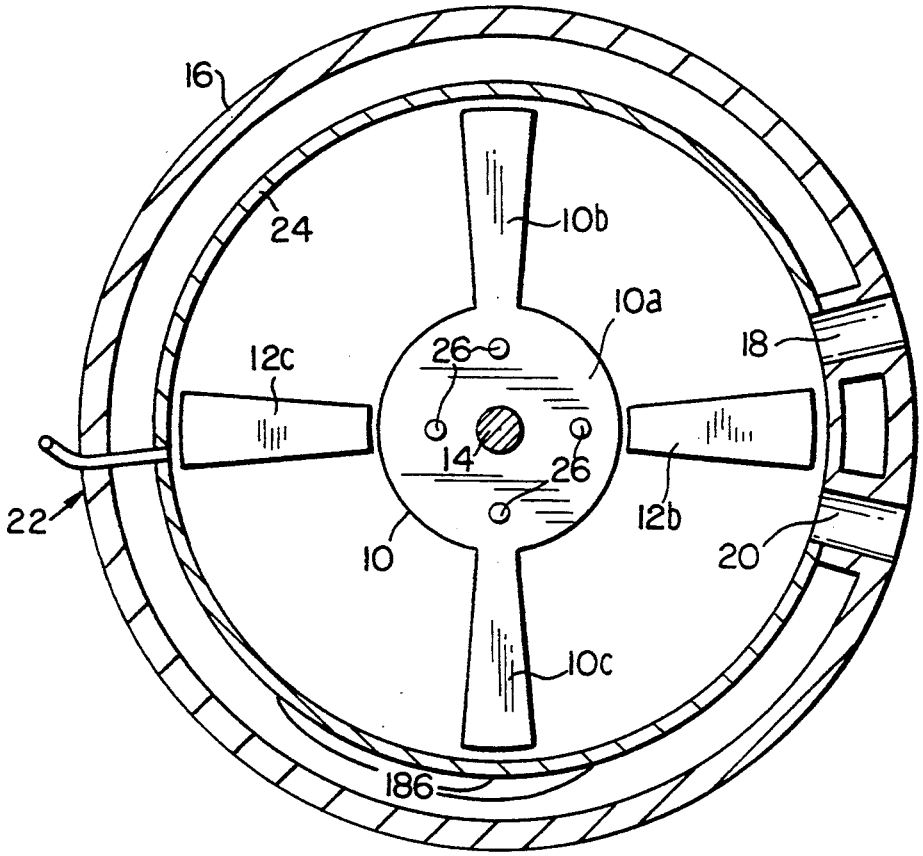
FIG. 3A is a transverse cross-sectional elevation of the engine block and paddle devices.
Figure 3C:
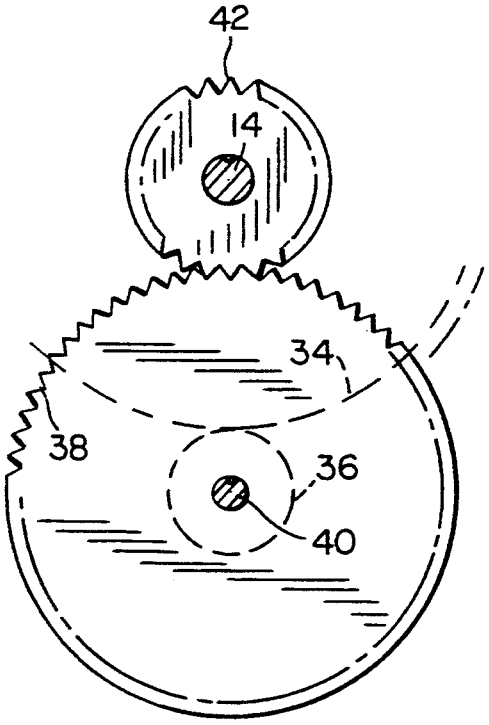
FIG. 3C is a partial, schematic and partly transverse-sectional elevation of large gear and pinion external elements.
Figure 3B:
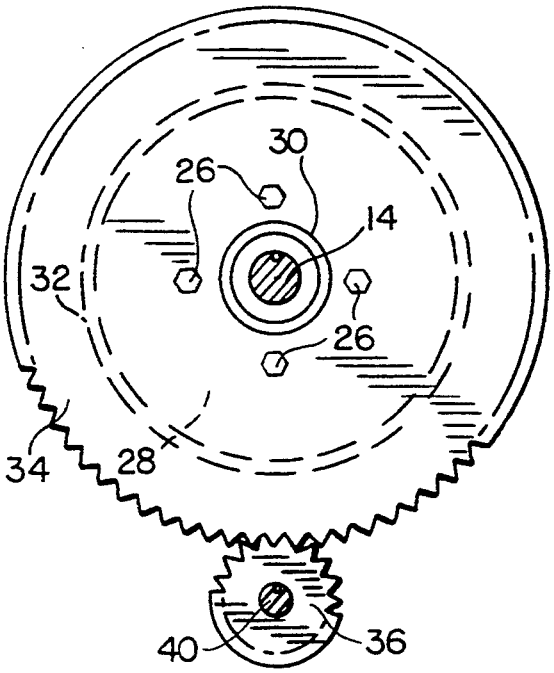
FIG. 3B is a partial, schematic and partly transverse-sectional elevation of intermediate mass, ratchets, peripheral gear and small gear external elements.

The basic external elements are the same for each paddle device 10, 12, but are shown generally in FIGS. 3A, 3B and 3C only for front paddle device 10 as the following:

- A direct connection arrangement 26 (merely illustrated as fasteners) connects an annular intermediate mass 28 to the hub 10*a*.
- Inner and outer concentric ratchets 30, 32, the inner ratchet being between the intermediate mass and the propeller shaft 14, and the outer ratchet being between the intermediate mass and a peripheral gear 34.
- A small gear 36 that engages the peripheral gear and a large gear 38 fixed to a common shaft 40.
- A pinion 42 that engages the large gear and is fixed to the drive shaft.

Figure 4:
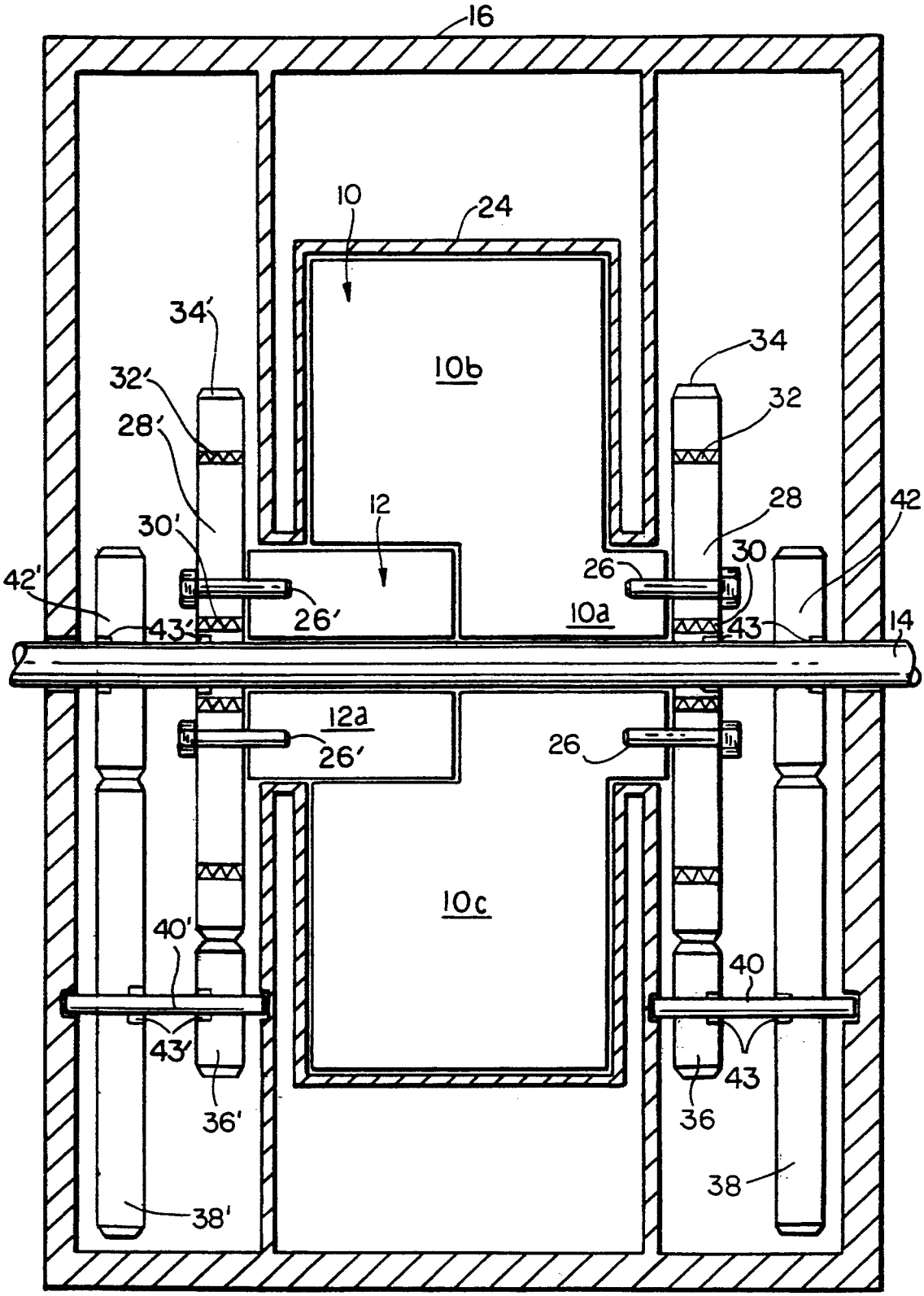
FIG. 4 is an axial cross-sectional elevation of internal and external elements of FIG. 1 to 3C.

Corresponding external elements for rear paddle device 12 are designated correspondingly with primes when shown in some later FIGS., e.g. FIG. 4.

In order for the internal elements to operate as an engine and produce a moving force, it is necessary that the internal combustion explosion force, at the ignition point that acts on the paddles, be transmitted in a coordinated way to the drive shaft. This is obtained with the external elements as seen in FIG. 4.

The hubs 10*a*, 12*a* of the paddle devices, through which the common shaft 14 rotates freely, jut out of opposite front and rear axial ends of the cylinder portion 24. The hubs are joined to respective intermediate masses 28, 28' having concentric inner and outer ratchets 30, 32; 30', 32' and peripheral gears 34, 34', with all the ratchets acting (i.e. slipping or holding) in the same rotational direction. Both paddle devices, therefore, make the drive shaft 14 rotate in the same direction.

BASIC OPERATION

Since the ratchets hold in the same rotational direction, one of the inner ratchets holds one of the paddle devices connected to the shaft at the time and as a consequence of the explosion taking place at the third quadrant. This is the rotationally leading or fast paddle device, which transfers its explosion-pushed rotation to the drive shaft.

This rotation of the shaft by the fast paddle device rotates the pinion 42' associated with the other paddle devices. The pinion turns the large gear, which turns the small gear 38', which turns the peripheral gear associated with the other paddle device in the same rotational direction as the fast paddle device and drive shaft. The outer ratchet 32' will thus hold to the peripheral gear 32' and turn the intermediate mass 38' and connected other paddle device in the same rotational direction, although much more slowly than the fast paddle device and drive shaft. This defines the other paddle device as the slow paddle device but, as a result, the slow paddle device also has a higher torque and therefore advances in the same rotational direction up to the ignition point in the third quadrant despite of a backward force of the explosion, whilst the fast paddle rotates past the outlet in the fourth quadrant.

In other words, the purpose of the external elements at the front and the rear ends is to assure that while the fast paddle device is moving onwards, the slow paddle device will also move in the same direction up to the ignition point and not move backwards as a consequence of the explosion force. (This is due to gear reductions described below.).

As both paddle devices have their own ratchet-and-gear external elements, one in the front and one in the rear, the fast paddle device performing the fast movement and moving the drive shaft, and the slow paddle device will alternate as the next explosion takes place at the ignition point.

It should always be kept in mind that we have assumed, only for illustration convenience, that the front-end of this engine is that from which the paddles are seen to rotate in trigonometrical (counterclockwise) direction. However, as both ends are identical, the axially opposite end may well be regarded as the front-end, for rotation in a more usual, or convenient, direction.

TABLE

| Explosion No. Starter | Admission | Compression | Explosion | Exhaust | |
|---|---|---|---|---|---|
| 1 | First | — | — | — | |
| 2 | Second | First | — | — | |
| 3 | Third | Second | First | | |
| 4 | Fourth | Third | Second | First | 1st cycle completed |
| 5 | Fifth | Fourth | Third | Second | 2nd cycle completed |
| 6 | Sixth | Fifth | Fourth | Third | 3rd cycle completed |
| ETC. | | | | | |

Figure 5A:
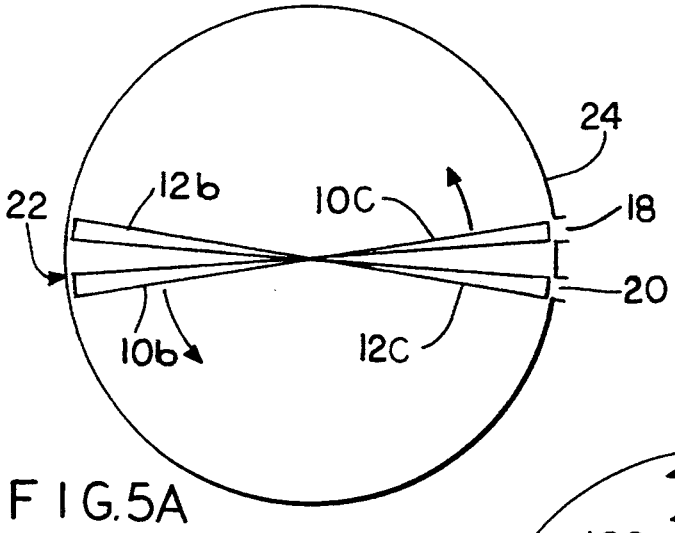
FIGS. 5A to 5D are transverse sectional schematic elevations for illustrating operation.
Figure 5B:
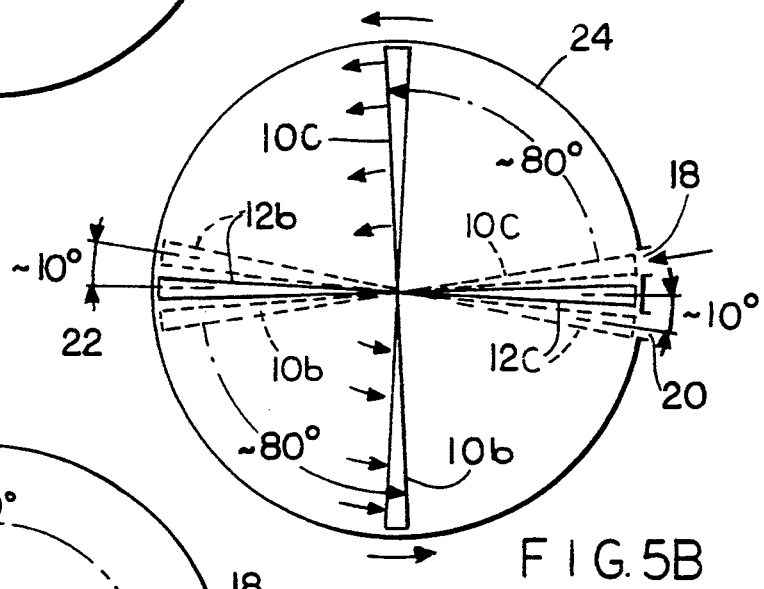

A first explosion of fuel and air at the ignition point 22, in the third quadrant of FIG. 5A, produces pressure shown by arrows in FIG. 5B, that separates the paddles **10*b*, 12*b* in the third quadrant, as also shown in FIG. 5B. The resulting indicated counterclockwise fast-paddle rotation of paddle 10*b* correspondingly rotates paddle 10*c* in the first quadrant for producing a first admission of air through inlet 18 as shown in FIG. 5B**.

Figure 5C:
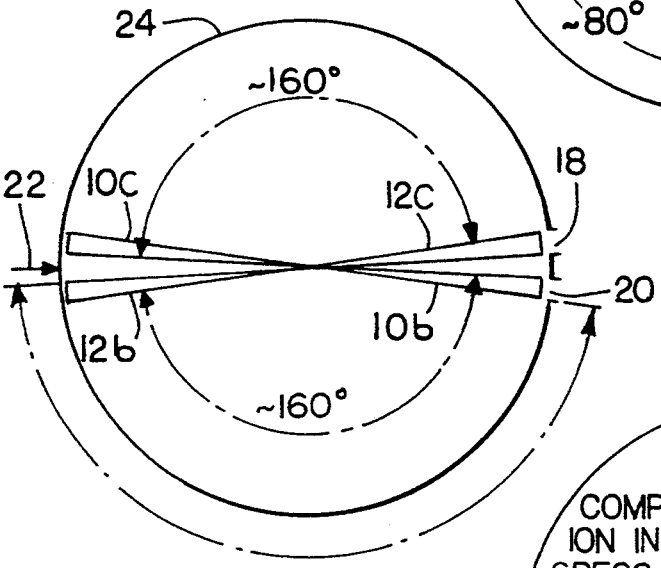

The concurrent slow counterclockwise rotation of the paddle **12*c*, that results from the ratchet and gear external elements described above, causes the slow paddle 12*c* to block the inlet 18 as shown in FIG. 5C. At the same time, the opposite-side fast and slow paddles 10*c* and 12*b* reach the ignition point 22, like paddles 10*b*, 12*b* in FIG. 5A. At this point, a second fuel/air explosion occurs at the ignition point, when paddle 10*b* discloses outlet 20**, and a second air admission takes place, whilst in the second quadrant the first air admission is being compressed.

In correspondence with the description above, the third explosion, activated when paddle **12*b* discloses outlet 20, starts a third air admission from inlet 18, compresses the second air admission in the second quadrant, and simultaneously explodes the first air admission when fuel is injected at the ignition point, as injector is activated when corresponding paddle discloses outlet 20. This paddle position, or earlier upstream, should fire the injector. The fourth explosion starts a fourth air admission from inlet 18, compresses the third air admission in the second quadrant simultaneously, explodes the second air admission at the ignition point, and exhausts the first exploded air admission through the outlet 20**.

Figure 5D:
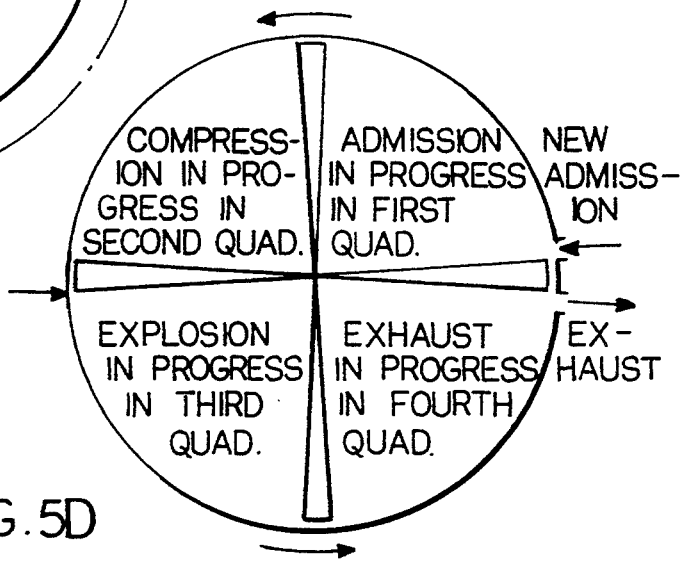

It results from the operation described above, therefore, that all four stroke functions of a conventional reciprocating-piston internal combustion engine occur simultaneously and continually in the four quadrants of the engine. This is shown in FIG. 5D, where admission is shown in progress in the first quadrant, compression is shown in progress in the second quadrant, air/fuel explosion is shown in progress in the third quadrant, and exhaust is shown in progress in the fourth quadrant.

In order to produce concurrent counterclockwise rotation of the alternate fast and slow paddles described above, it is necessary that, when an explosion takes place, one of the paddles (the slow paddle) must be prevented from moving backwards, whereby the pressure obligates the other paddle (fast paddle) to move onwards, transmitting its impelling rotation force to the drive shaft through the inner ratchet, as described above.

In the case taken only as an example, a total gear reduction of 8:1 will increase by eight times the opposing force of the slow paddle to prevent the slow paddle from rotating backwards, but instead, force it to rotate onwards despite the explosion force, which is overpowered.

Thus, as shown in FIG. 5C, the fast paddle produces a rotation of about 160° for the drive shaft, while the slow paddle, due to the rotation of the drive shaft in mesh with the gears of the outer ratchet, will only move onwards about 20°. However, this 20° rotation is enough to place the slow paddle at the ignition point, thus initiating the next explosion and causing the slow paddle to become the fast paddle, and vice versa, and then so on for the next explosion.

Instead of valves (as in other engines), the invention uses simple inlet and outlet openings 18, 20 at appropriate locations to be open or closed as the paddles pass by. The arc length between the ignition point 22 and the exhaust outlet 20 is critical, because the burnt gases of the last explosion must be exhausted before the next explosion occurs. Moreover, this arc length also determines the amplitude of the rotational separation of the paddles as the fast paddle advances away from the slow paddle, which determines the volume of air that can be admitted from the first quadrant for the next explosion, and the volume of air after compression in the second quadrant, thus determining the Compression Ratio as well as the geared reductions.

MORE DETAILED DESCRIPTION

It has already been described how rotation of pinion 42 rotates large gear 38, which rotates shaft 40, which rotates small gear 36, which rotates peripheral gear 34. FIG. 4 shows keys 43 on the shaft 14 and shaft 40 that assure this.

Figure 6A:
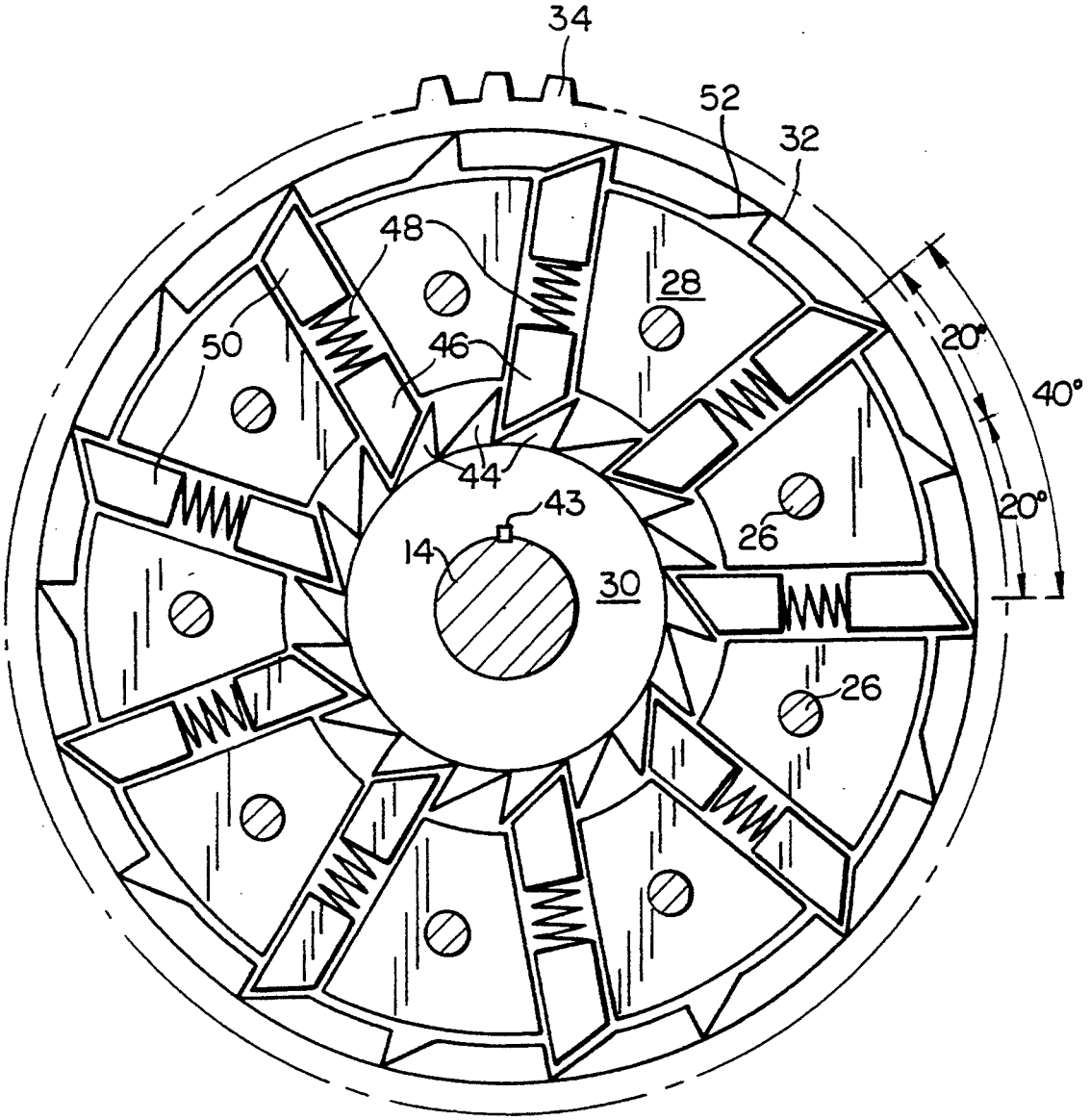
FIG. 6A is a front elevation, partly in section and partly cut away of some of the external elements of the front end of FIG. 4.

FIG. 6A shows, therefore, the key 43 that assures rotation together of the inner ratchet 30 and shaft 14. To rotate the inner ratchet 30, the inner ratchet has sawteeth 44 around its outer periphery that are inclined to permit rotation of the inner ratchet 30 counterclockwise relative to the intermediate mass 28, but not clockwise.

To hold counterclockwise rotation of the intermediate mass 28 with the inner ratchet 30, the inner ratchet also has teeth 46 in the intermediate mass. The teeth 46 are loaded radially inwardly by respective springs 48 to engage the teeth 44 with which they are correspondingly shaped. This forms the inner ratchet 30(44/46).

The same springs 48 respectively load radially outwardly further teeth 50 in the intermediate mass that engage correspondingly shaped teeth 52 on an inner surface of the peripheral gear 34. The teeth 50 and 52 are shaped to permit counterclockwise rotation of the intermediate mass relative to the peripheral gear, but not clockwise rotation. This forms the outer ratchet 32(50/52).

Figure 6B:
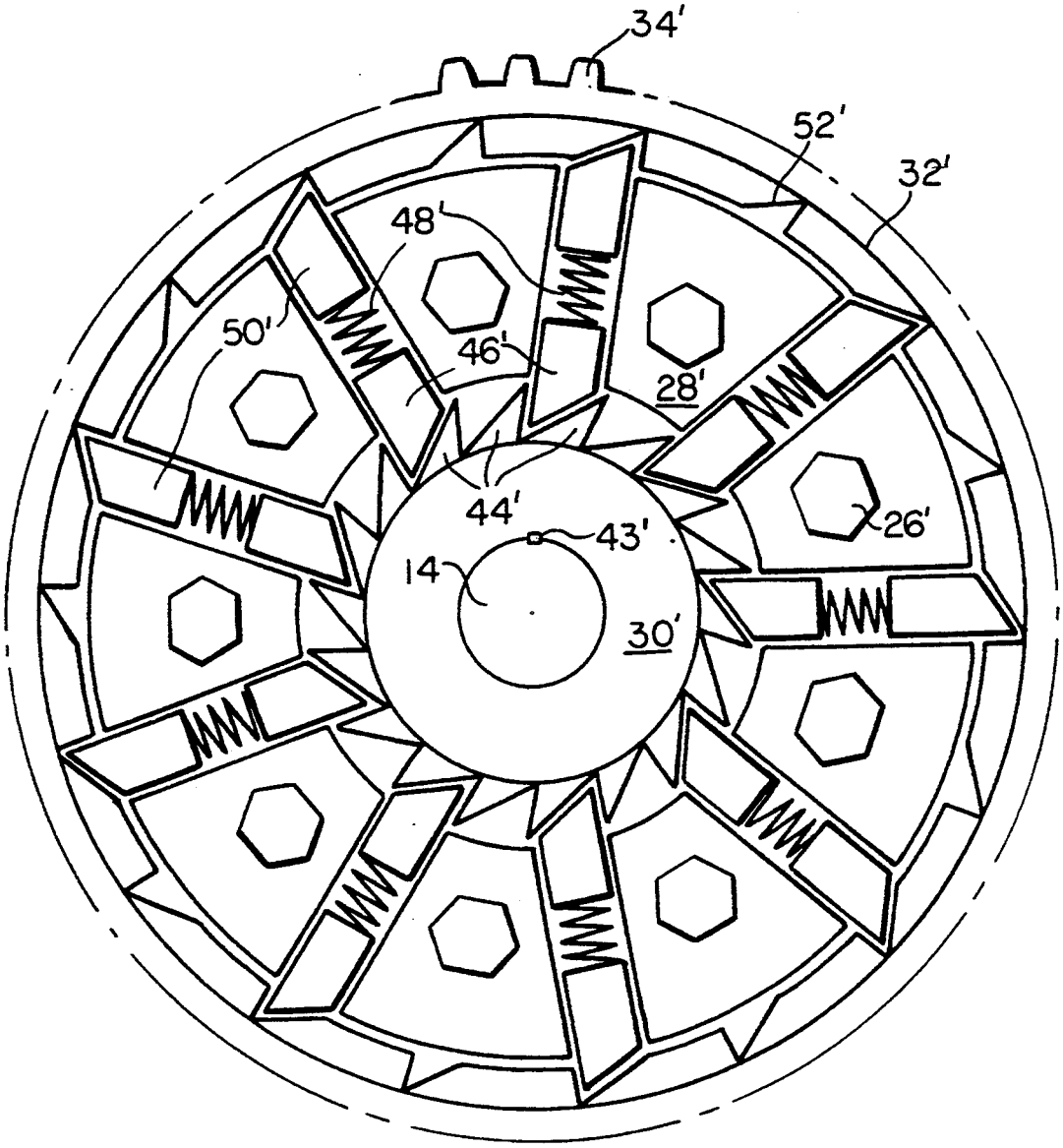
FIG. 6B is a front elevation, partly in section and partly cut away of some of the external elements of the rear end of FIG. 4.

FIG. 6B shows a front view of the corresponding elements of the rear-end intermediate mass 28', inner ratchet 30', outer ratchet 32' and peripheral gear 34'.

These will be seen to be identical to the front view of the corresponding elements of the front end shown in FIG. 6A. This shows how the front and rear-end ratchets turn the shaft 14 in the same direction merely by having the front and rear-end ratchets arranged, from left to right in FIG. 4, front to back. Advantages in construction from the identity of the front- and rear-end ratchets will be immediately apparent.

Figure 7:
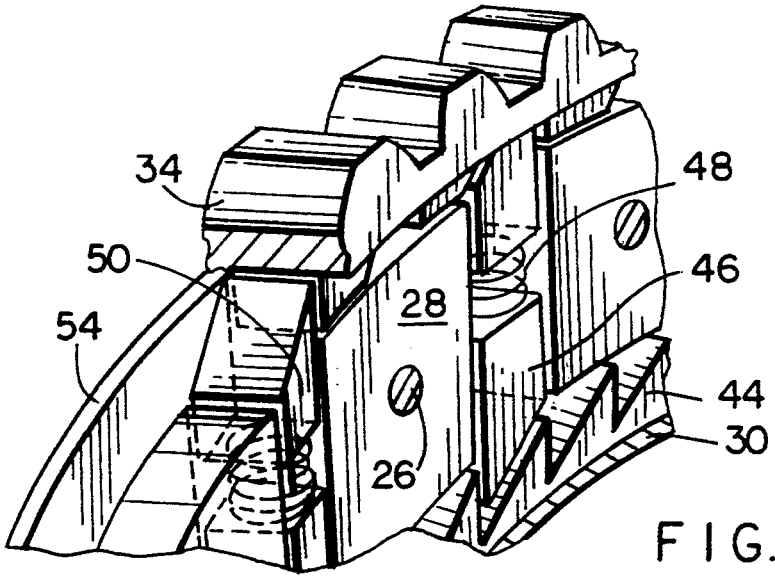
FIG. 7 is a front/top/left side perspective view of portions of some of the external elements of FIG. 4.
Figure 8:
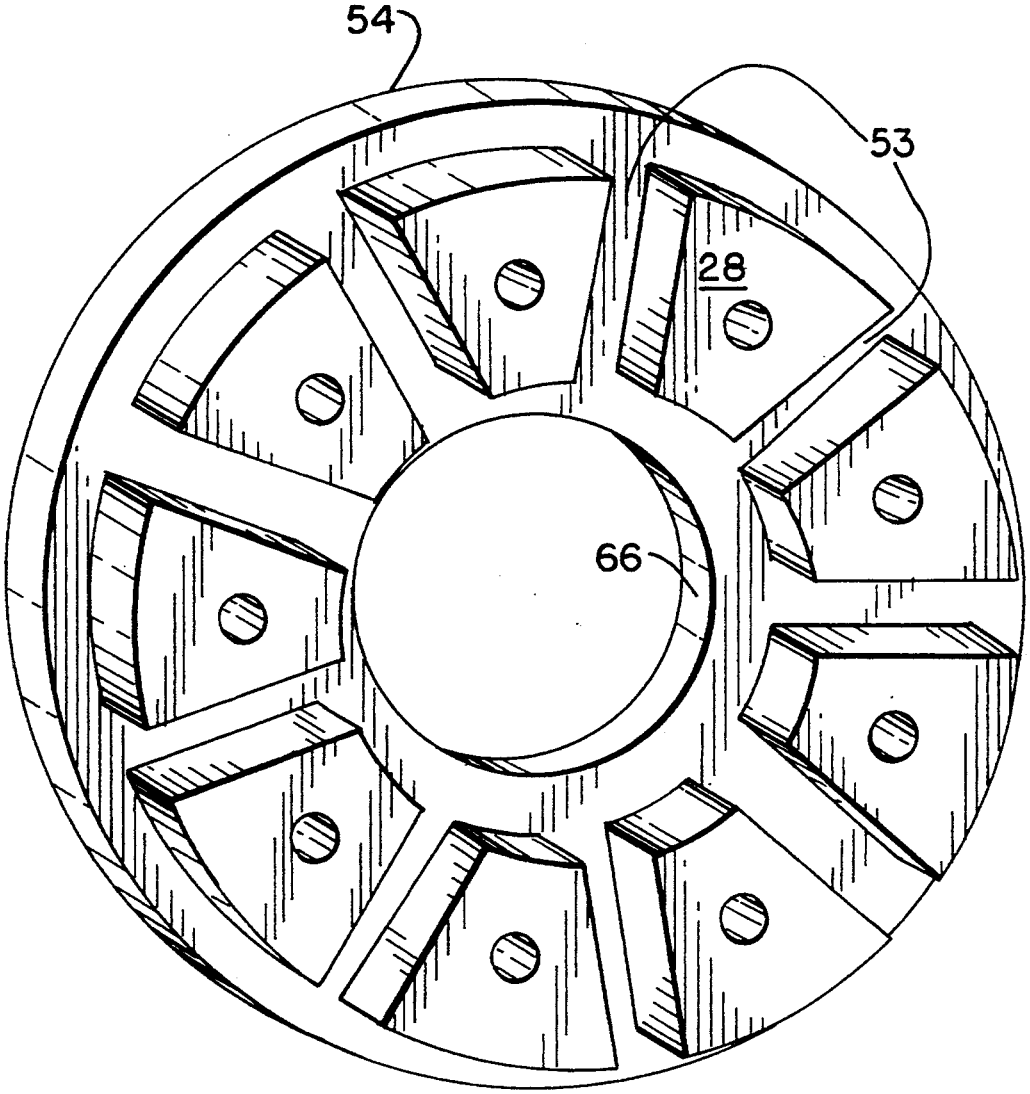
FIG. 8 is a front/top/left side perspective view of an intermediate mass external element of FIG. 4.
Figure 9:
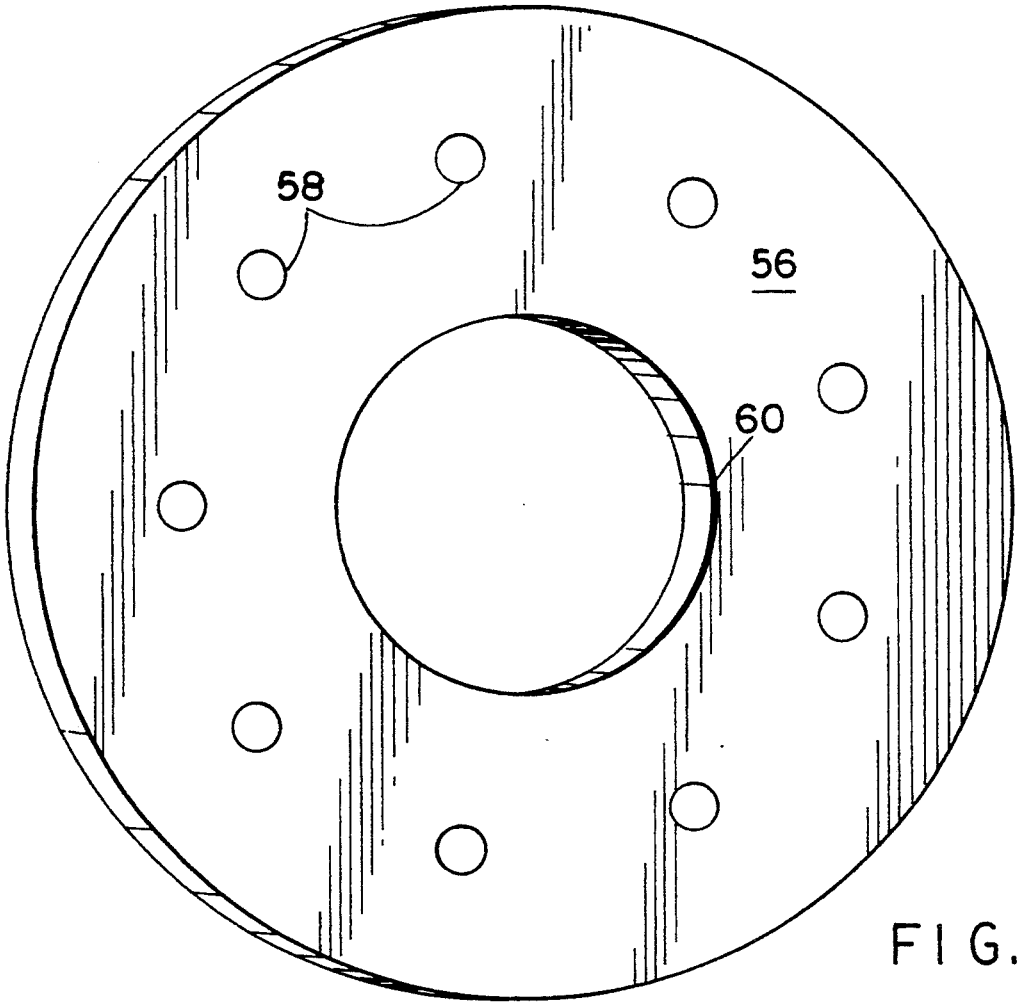
FIG. 9 is a front/left side perspective view of a retention disc external element of FIG. 4.
Figure 10A:
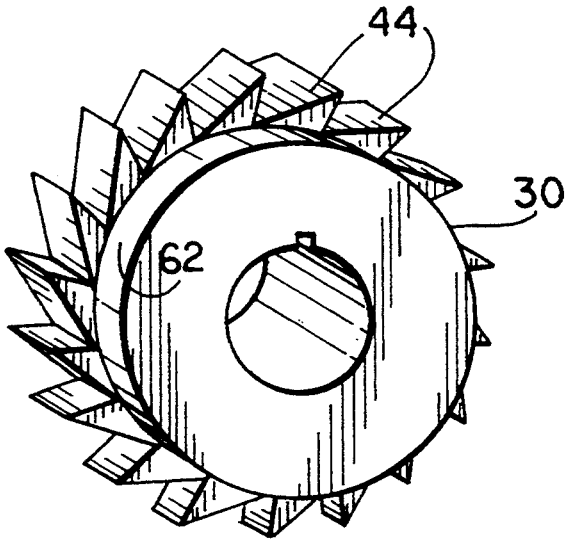
FIG. 10A is a front/top/left side perspective view of an inner ratchet external element of FIG. 4.
Figure 10B:
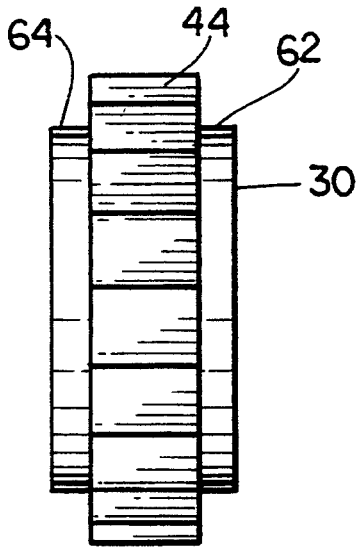
FIG. 10B is a transverse elevation of the inner ratchet external element of FIG. 10A.

As clear from FIGS. 7 and 8, the teeth 46 and 50 and springs 48 are in radial slots 53 in the intermediate mass. The intermediate mass has a rear disc portion 54 that provides rear-side axial support to the spring loaded teeth 46 and 50 of the inner and outer ratchets and the peripheral gear 34. Front side axial support is provided by a retention disc 56 that is shown in FIG. 9. Openings 58 in the retention disc accommodate the direct connection arrangement 26 (FIG. 6), which also holds on the retention disc. A central opening 60 in the retention disc accommodates a front axial projection 62 (FIG. 10A) of the inner ratchet 30 for radial support to the inner ratchet. As shown in FIG. 10B, a corresponding rear axial projection 64 provides rear radial support in an opening 66 (FIG. 8) in the rear disc portion 54 of the intermediate mass.

MORE DETAILED DESCRIPTION OF OPERATION

Figure 11:
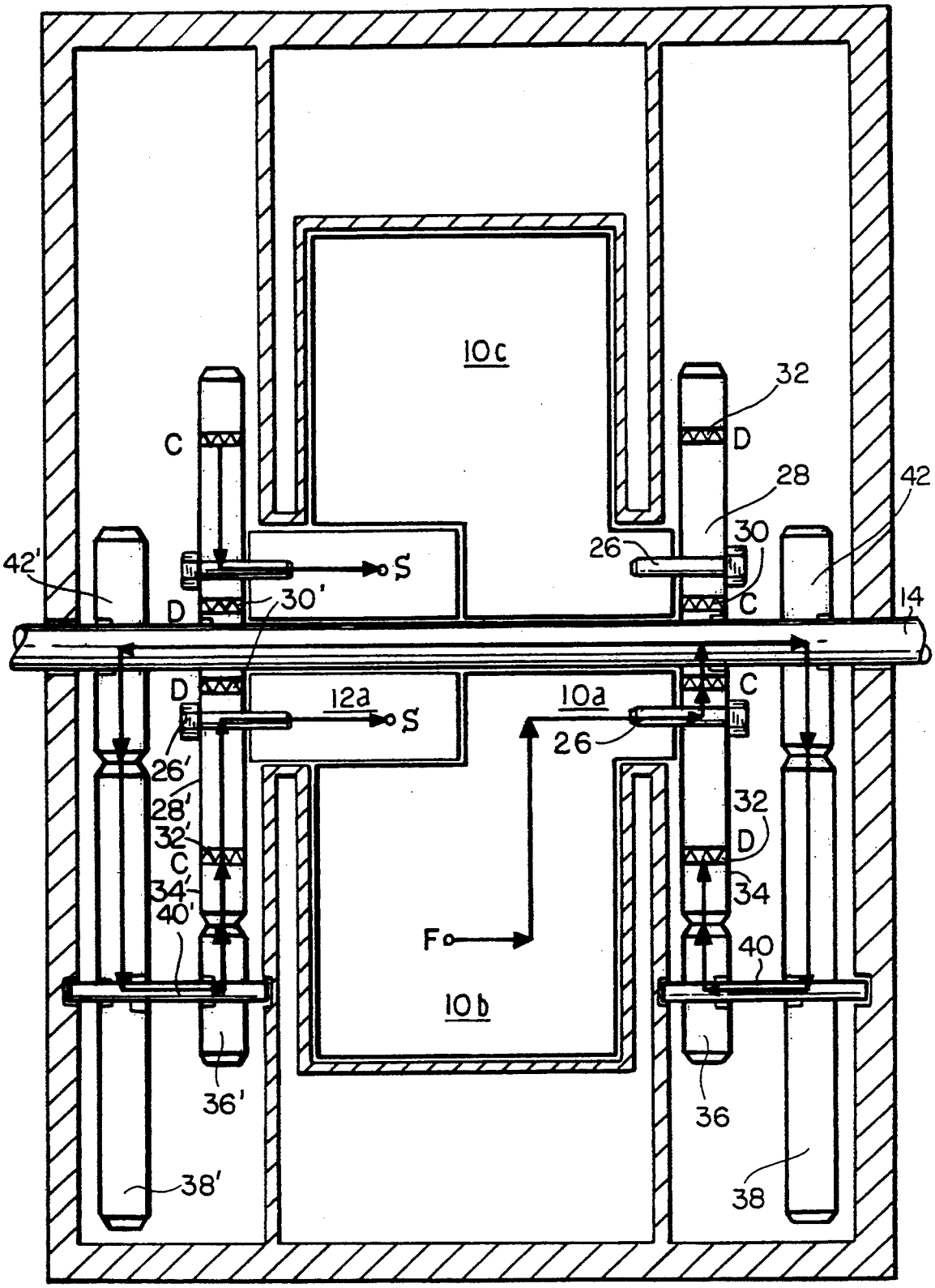
FIG. 11 is an axial cross-sectional elevation of internal and external elements similar to FIG. 4, but with drive-indicating arrows.

As shown in FIG. 11, paddle 10*b* is the explosion-driven fast paddle. That is, the engine is at least approximately in the condition shown in FIG. 5B with the pressure of a combustion explosion fast driving paddle 10*b* counterclockwise away from the viewer of FIG. 11 and the plane of FIG. 11. A drive-indicating arrow thus starts from the letter F on fast paddle 10*b*. The fast, explosion-driven rotation of paddle 10*b* correspondingly rotates the hub 10*a* of the paddle 10*b* and, through the direct connection arrangements 26, the intermediate mass 28. The drive-indicating arrow shows this progress of the fast, explosion-driven rotation to the intermediate mass 28.

Figure 13A:
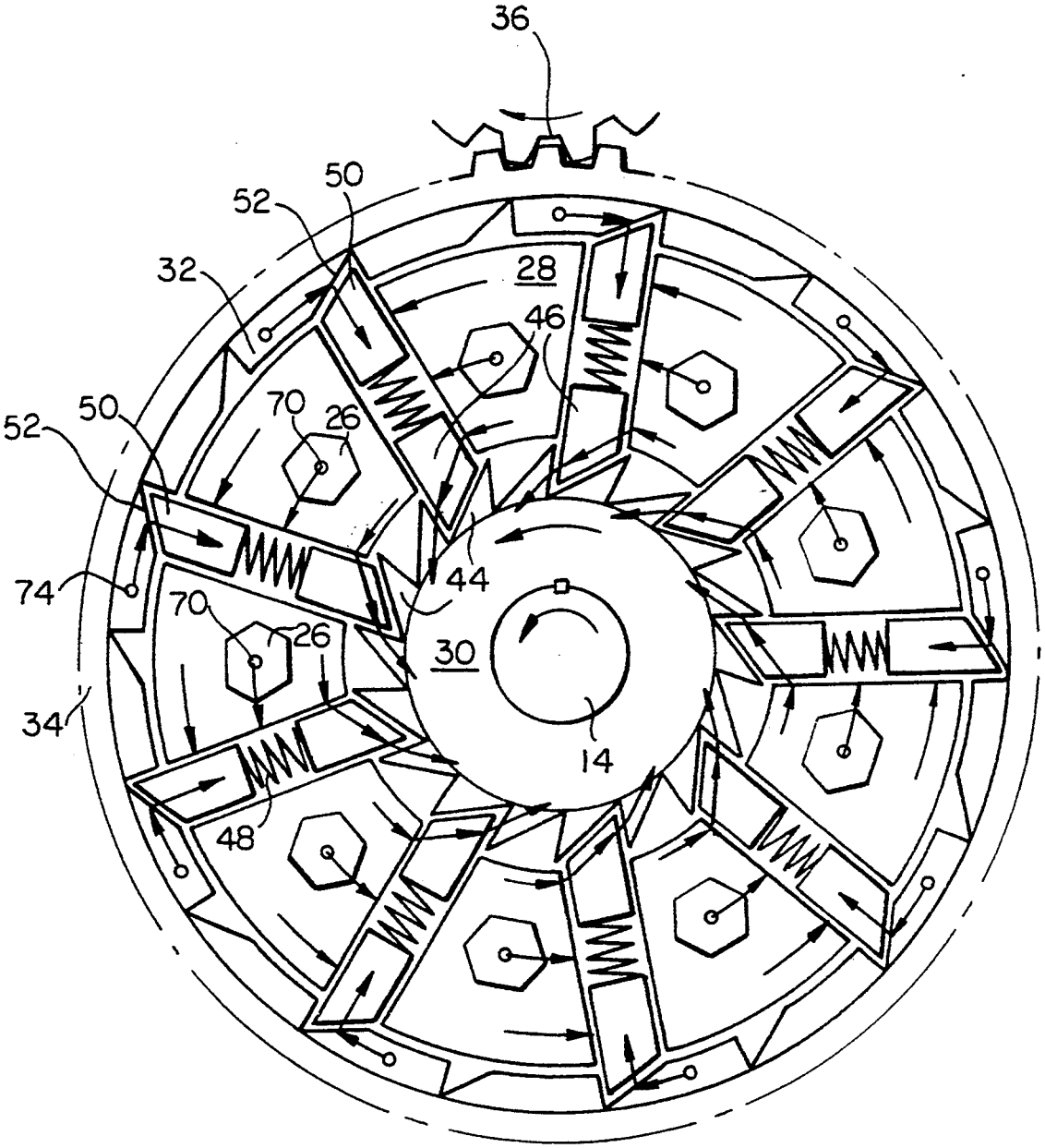
FIGS. 13A and 13B are front elevations, partly in section and partly cut away of the external elements of FIGS. 6A and 6B with the drive-indicating arrows of FIG. 11.

As understood from FIGS. 6A and 13A, the fast, explosion-driven rotation of the intermediate mass 28 is transferred to the inner ratchet 30 through the teeth 46 that the springs 48 push into the teeth 44. The inner ratchet 30 on the front end of the engine (right side of FIG. 11 as understood from FIG. 4) is, therefore, connected or held as indicated with a C in FIG. 11.

The fast, explosion-driven rotation of the intermediate mass that is transferred to the inner ratchet 30 is then transferred from the inner ratchet to the keyed-on shaft 14. The drive-indicating arrow thus extends to the shaft and through the shaft to the front and rear (right and left in FIG. 11) pinions 42, 42'.

Considering first the front-end pinion 42 (on the right in FIG. 11), the drive shaft turns the pinion at the fast speed. Pinion 42 then turns the large gear 38, but as indicated by their relative diameters, there is a gear reduction of 2:1 from the pinion to the large gear. The large gear 38 thus rotates at a slower, medium speed that is half that of the fast paddle 10*b*, intermediate mass 28 and pinion 42.

The large gear 38 then turns the shaft 40 and small gear 36 at the same, medium speed and the drive-indicating arrow therefore continues to the peripheral gear 34. As indicated by their relative diameters, there is a gear reduction of 4:1 from the small gear to the peripheral gear 34. The small gear thus rotates the peripheral gear at one-quarter the rotational speed of the small gear, shaft and large gear, which as described above, is already half the fast, explosion-driven rotational speed of the paddle 10*b*. The peripheral gear thus rotates at one-eighth the rotational speed of the fast paddle 10*b* and intermediate mass 28 as a result of the overall 8:1 gear reduction from paddle 10*b* along the path of the drive-indicating arrow from the paddle 10*b* through the peripheral gear to the outer ratchet 32.

The direction of the one-eighth speed rotation of the peripheral gear 34 is counterclockwise. Starting from the counterclockwise rotation of the paddle 10*b*, the direct connection arrangement connection of the hub 10*a* turns the intermediate mass 28 counterclockwise and the inner ratchet 30 turns the shaft 14 counterclockwise. The shaft 14 turns the pinion 42 counterclockwise, but the pinion turns the large gear 38, shaft 40 and small gear 36 clockwise. The clockwise rotation of the small gear then turns the peripheral gear 34 counterclockwise.

Returning to FIGS. 6A and 13A, it may seem that the counterclockwise rotation of the peripheral gear 34 would allow the springs 48 to engage the teeth 50 and 52 of the outer ratchet 32, but this is not the case. As described above, the rotation of the peripheral gear is at one-eighth the fast rotational speed of the paddle 10*b* and the intermediate mass 28. The fast rotational speed of the paddle 10*b* and the intermediate mass 28 is, moreover, also counterclockwise.

The relative rotation of the peripheral gear 34 and outer ratchet 32 with respect to the intermediate mass 28 and the is, therefore, clockwise, because the intermediate mass 28 is rotating counterclockwise eight times faster than the peripheral gear. The inclined parts of sawteeth 52 of the peripheral gear thus press the inclined parts of the teeth 50 against the springs 48 so that the outer ratchet 32 slips or is disconnected, as indicated by a D in FIG. 11. As a result, the drive-indicating arrow stops at the outer ratchet 32 on the right hand, front end in FIG. 11.

Returning to the portion of the drive-indicating arrow in the shaft 14 that extends to the left hand, rear end in FIG. 11, this indicates that the drive shaft also turns the inner ratchet 30' counterclockwise at the fast, explosion-driven rotational speed of the paddle 10*b*, intermediate mass 28 and inner ratchet 30 described above. As seen from FIGS. 6B and 13B, therefore, the inclined parts of the sawteeth 44' of the inner ratchet 30' then push the corresponding parts of the teeth 46' against the springs 48' until the inner ratchet 30' slips relative to the intermediate mass 28'. The inner ratchet is, therefore, disconnected and does not rotate the intermediate mass 28'. This is indicated with another D in FIG. 11 and the fact that the drive-indicating arrow does not extend from the propeller shaft into and through the inner ratchet 30' to the intermediate mass 28'.

The pinion 42' is keyed to the shaft 14, however, and, therefore, must rotate with the shaft 14 at the fast, counterclockwise, explosion-driven rotational speed of the paddle 10*b*. The pinion 42' then rotates the large gear 38' shaft 40' and small gear 36' in a way analogous to that already described for the pinion 42, large gear 38, shaft 40 and small gear 36 of the right hand, front end in FIG. 11. It will thus be clear that the small gear rotates the peripheral gear 34', and outer ratchet 32', counterclockwise at one-eighth the rotational speed of the shaft 14 and paddle 10*b*.

Because the inner ratchet 30' slips to disconnect and not rotate the intermediate mass 28' as described above, the counterclockwise rotation of the peripheral gear 34' allows the springs 48' to engage the teeth 50' with the teeth 52' to hold the peripheral gear 34' to the intermediate mass 28'. The peripheral gear and intermediate mass are, thus, connected by the outer ratchet 32' and the intermediate mass 28' rotates counterclockwise. This is indicated by a C in FIG. 11 and the passage of the drive-indicating arrow through the ratchet into the intermediate mass 28'.

The direct connection arrangement 26' then carries the one-eighth speed counterclockwise rotation of the intermediate mass 28' to the hub 12*a* of the other, slow paddle device. The paddles 12*b*, 12*c* (FIG. 5B) of the other paddle device thus rotate in the same counterclockwise direction as the fast paddle 10*b*. Further, this rotation of the paddles 12*b*, 12*c* is at a slower rotational speed S, one-eighth the rotational speed of the fast paddle 10*b*, all in correspondence with FIGS. 5A to 5C.

The explosion pressure indicated by the arrows on fast paddle 10*b* in FIG. 5B also acts equally on slow paddle 12*b* that is following in the third, ignition quadrant of FIG. 5B. The force of the pressure on paddle 10*b* is multiplied, however, by the external elements to the paddle 12*b* that have just been described and this assures the concurrent counterclockwise rotation of both paddles 10*b* and 12*b* as described above.

More specifically, the 8:1 gear reduction of the pinion 42', large gear 38', small gear 36' and peripheral gear 34' that reduces the speed of rotation of the hub 12*a* and its paddle 12*b* (FIG. 5B) to one-eighth the rotational speed of the fast paddle 10*b* as described with reference to FIG. 11 also produces an eight-fold increase in the torque acting on hub 12*c* as compared to that of paddle 10*b* acting on hub 10*a*. The torque from the explosion pressure acting on paddle 10*b* is thus multiplied eight-fold on the hub 12*a* to force paddle 12*b* against the same explosion pressure in the counterclockwise direction as shown in FIG. 5B.

Figure 12:
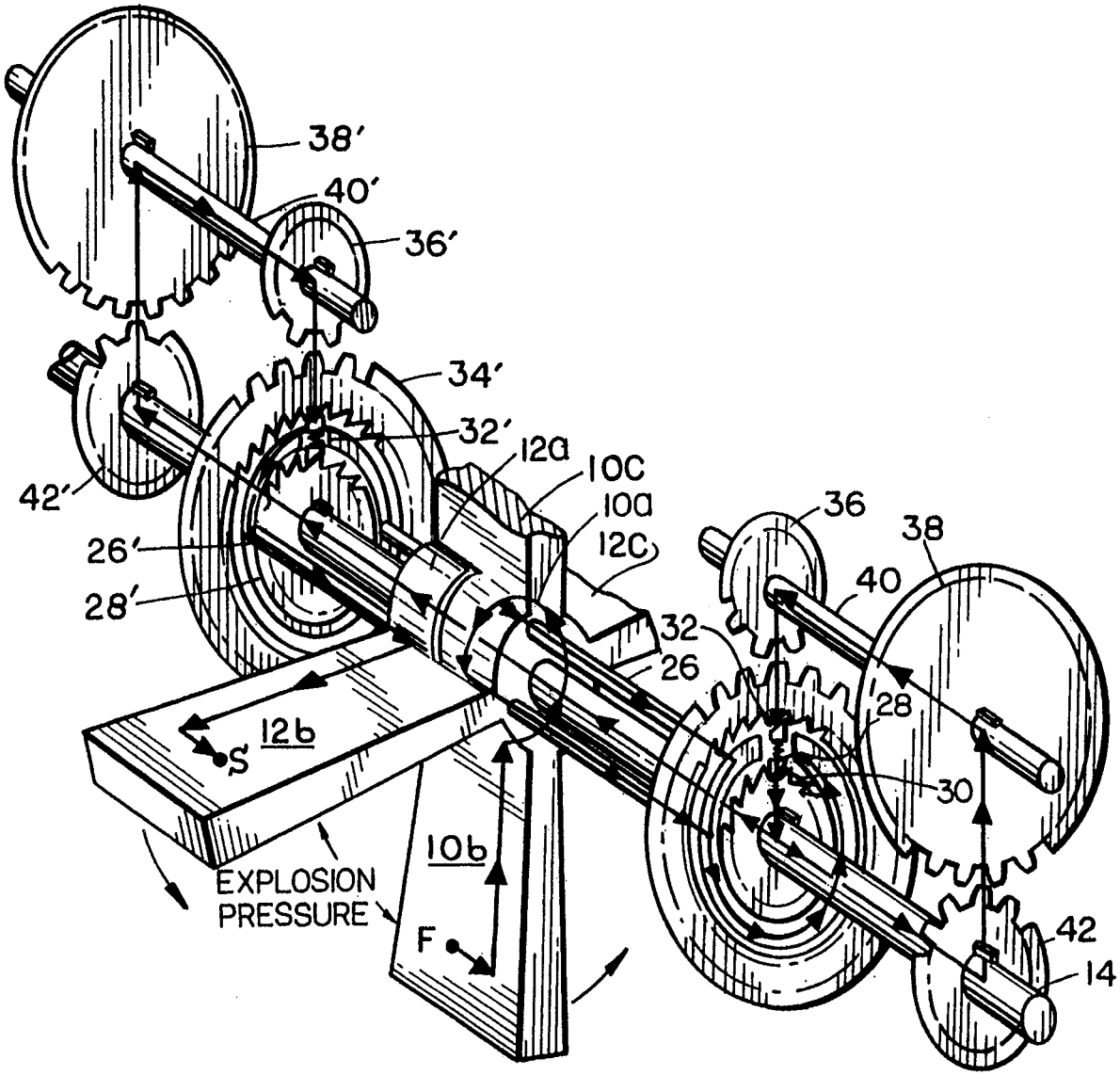
FIG. 12 is a schematic perspective illustration of the elements and drive-indicating arrows of FIG. 11.

FIG. 12 shows the same torque transmission of the explosion pressure as FIG. 11. In the schematic of FIG. 12, however, some of the external components such as the large gears 38, 38' have been moved from under the shaft 14 to above the shaft only for clarity.

FIG. 12 shows that the explosion pressure acts effectively on the paddle 10*b* at the point F that is at a radial distance from the shaft 14. The explosion force thus produces a torque on the hub 10*a* that is the force of the explosion pressure at center-of-mass point F multiplied by the radial distance of the point from the shaft. It will be appreciated, therefore, that because the paddle 10*b* is elongated, substantial torque is produced on the hub 10*a*, the rotational component of this torque in hub 10*a* being indicated by the schematic curve of the drive-indicating arrow as it passes through the hub 10*a*.

The torque of the drive-indicating arrow in the hub 10*a* in FIG. 12 is transmitted through the direct connection arrangement 26 to the intermediate mass 28 and through the inner ratchet 30 to the shaft 14, as described with reference to FIG. 11.

The drive-indicating arrow further shows how the torque is transmitted through the pinion 42, but stopped at outer ratchet 32 on the right hand, front end in FIG. 12 as described before with reference to FIG. 11. On the left hand, rear end, however, the same progression of the torque from the shaft 14 through the pinion 42' to the outer ratchet 32' continues into the intermediate mass 28' on the basis of the counterclockwise rotation of the peripheral gear 34' that was described with reference to FIG. 11. The rotation of the intermediate mass 28' is, therefore, indicated by the arcuate passage of the drive-indicating arrow therethrough to one of the fasteners 26' that carry the torque to the hub 12*a*. This torque at one-eighth the speed but eight times the force as the torque on the hub 10*a*, extends from the hub 12*a* to the point S on paddle 12*b* that corresponds to the effective location of the explosion pressure described with reference to point F on paddle 10*b*. The torque acting on the paddle 12*b* is, therefore, eight times the torque produced by the paddle 10*b*, whereby both paddles 10*b* and 12*b* rotate in the same counterclockwise direction, indicated by the arrows in FIG. 12 and previously described.

It will be understood from the above descriptions that the transmission of driving force through the two ratchets on the front and rear ends of the engine is an essential feature of the operation of the engine that has been described. The relative force transmissions through the ratchets of the front and rear end are, therefore, described in further detail with reference to FIG. 13A and 13B. In these Figs., the points at which the force of the explosion pressure enters the figures are indicated with dots and the transmission of these forces is indicated by a chain of successive arrows.

In FIG. 13A, therefore, the force from the explosion pressure enters the Fig. at dots 70 on the direct connection arrangement (fasteners) 26 that connects the intermediate mass 28 to the hub 10*a* of paddle 10*b* as shown in FIGS. 11 and 12. The chains of arrows from the intermediate mass through the teeth 46, 44 into the inner ratchet 30 indicate how the shaft 14 is rotated. The corresponding arrow from the intermediate mass 28 toward the teeth 50 of the outer ratchet do not continue in a chain to show that the outer ratchet slips or is disconnected. This is because the force from the rotating shaft re-enters FIG. 13A at the dots 74 on the peripheral gear 34 as previously described with reference to FIG. 11. The force from the dots 74 is transferred through the sawteeth 52 to the corresponding sawteeth 50 of the outer ratchet 32, whereby the teeth 50 move radially inward against the springs 48 and the outer ratchets slips or is disconnected as previously described.

Figure 13B:
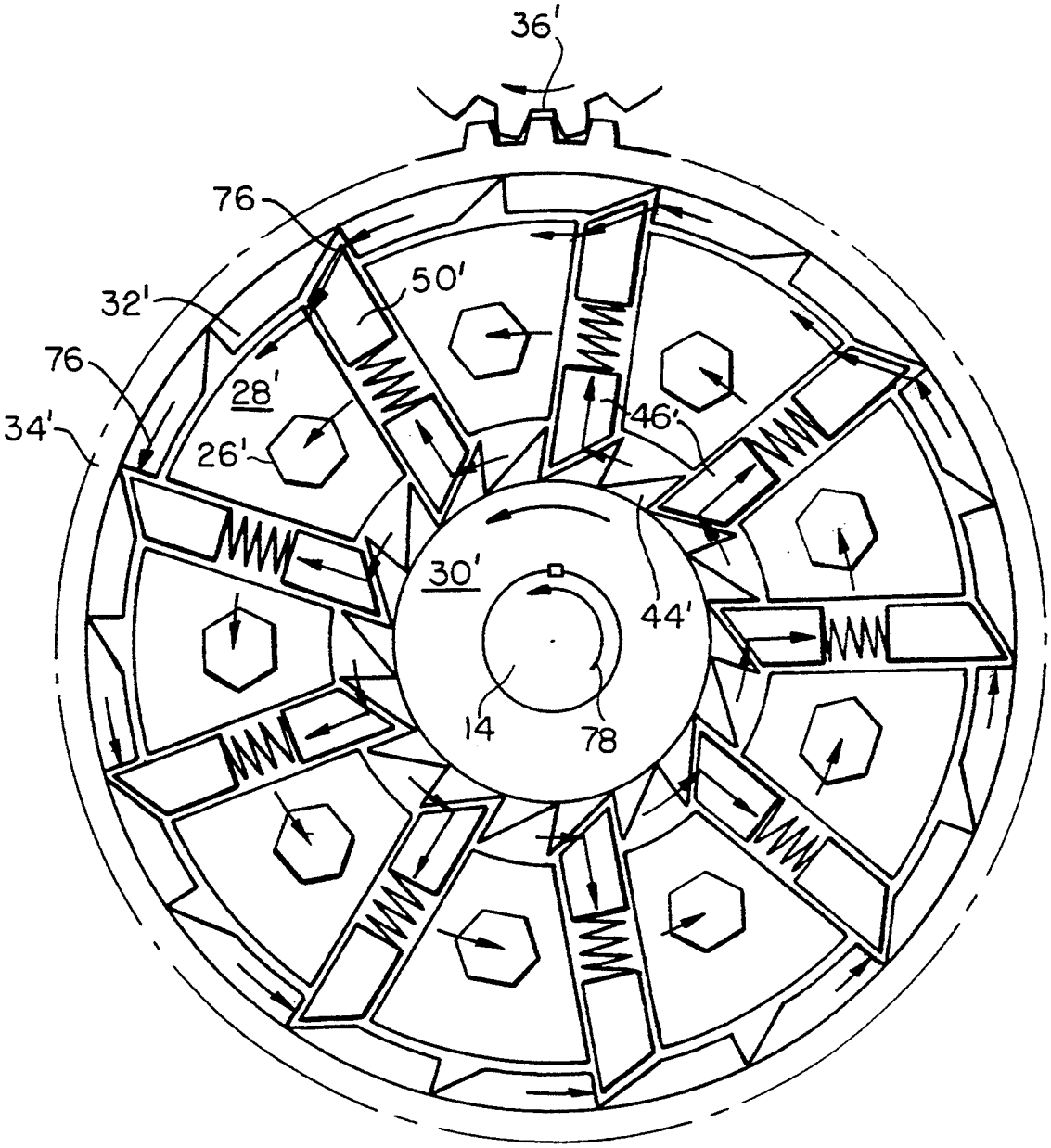

In FIG. 13B the force of the explosion pressure enters the figure at the dots 76 at the outer ratchet 32'. The force is then transferred from the peripheral gear 34' through the teeth 50' to the intermediate mass 28'. From the intermediate mass 28' the force exits through the direct connection arrangement (fasteners) 68' to the hub 12*a* (FIG. 11) of the slow paddle as previously described.

The explosion force also enters FIG. 13B at point 68 in the shaft 14. This is transferred to the connected inner ratchet 30' but the teeth 44' of the inner ratchet push the teeth 46' radially outward as indicated by the arrows to disconnect the inner ratchet 30' from the intermediate mass 28'.

Together, therefore, FIGS. 13A and 13B depicted the force transmissions through the identical inner and outer ratchets at the front and rear ends of the engine.

STARTING

When the engine is stopped by cutting off fuel, the paddles may stop in any of the above-described angular orientations relative to each other. To then start the engine, a known starter (not shown) is operated to rotate the shaft 14 (FIG. 2) counterclockwise. As clear from FIG. 4, this will rotate the pinions 42,42' and therefore peripheral gears 34,34' counterclockwise. As clear from FIGS. 6A and 6B, this will engage the outer ratchets 32,32' to connect the peripheral gears 34,34' to the intermediate masses 28,28' and thus, through the direct connection arrangement 26,26' (FIG. 4), to rotate the hubs **10*a*, 12*a* counterclockwise, but with paddles 10*b*, 10*c* and 12*b*, 12*c* still in the relative angular orientation they stopped in. The stroke-like cycles of engine operation shown in FIG. 5D** thus will not occur.

It is necessary, therefore, to provide an ignition device (not shown) of a known sparkplug or glowplug type, for example, at the ignition point 22 in the third quadrant. The ignition device will be activated every time a paddle discloses outlet 20, and will explode fuel from a nozzle and whatever air is between whatever successive paddles are then rotating past the ignition point. Although this starting explosion is at least likely to be imperfect, its explosion pressure will produce at least some fast-paddle/slow-paddle operation as described above. Successive starting explosions thus increasingly tend to orient the paddles toward the relative orientation shown in FIG. 5A from which the diesel operation described above with reference to FIGS. 5A to 5D commences.

OTHER EMBODIMENTS AND BEST MODES

The embodiments described above are merely exemplary. Other embodiments are contemplated and contemplated as within the scope of the invention defined by the claims.

For example, it is apparent that the springs 48,48' of FIGS. 6A and 6B can be eliminated if the teeth 46,50 and 46', 50' are rigidly connected, because these teeth are complementary and one of the inner and outer ratchets 30,32 and 30', 32' is always engaged or connected and one always skipping or disconnected.

The high torque of the engine also suggests that the best mode should have a larger diameter inner ratchet 30,30' than shown in the Figs. This would reduce force transmission therethrough and, thus, structural requirements and wear.

Figure 14:
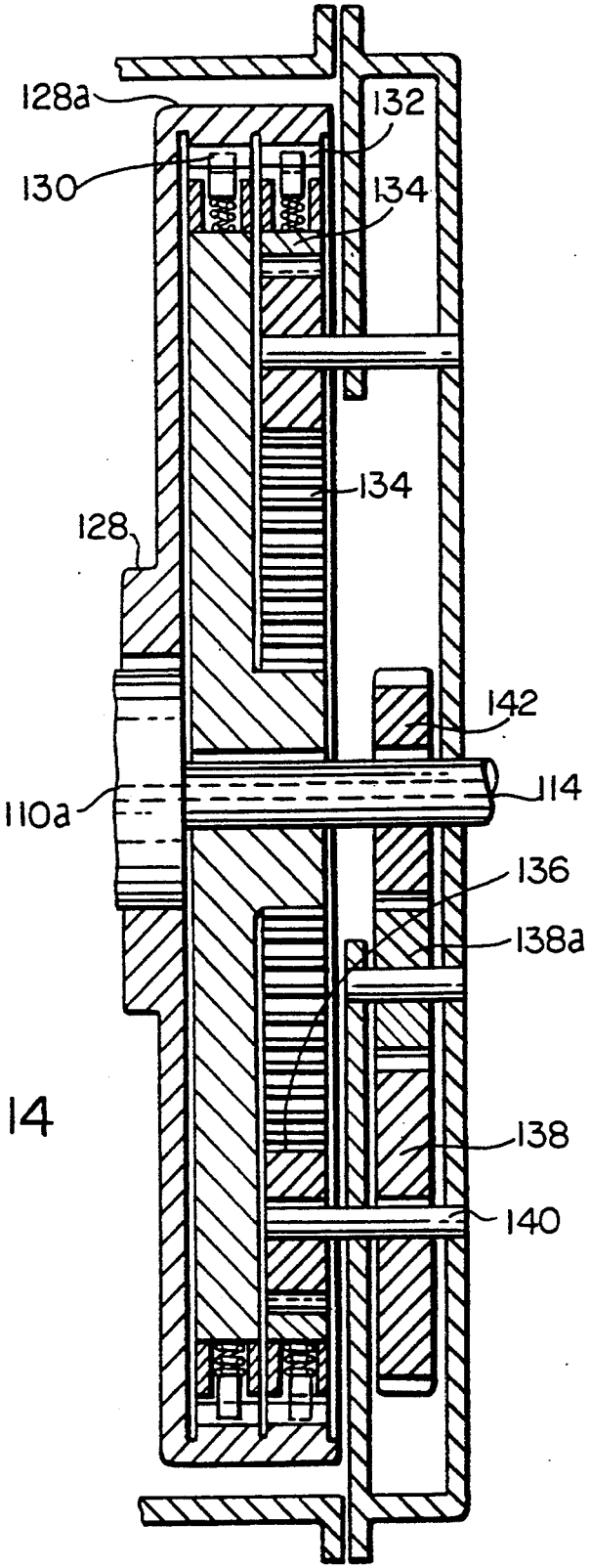
FIG. 14 is a schematic, transverse sectional elevation of another embodiment.

In fact, the inventors contemplate, as a best mode shown in FIG. 14, hubs **110*a* (cf. 10*a* in FIG. 4) that are still directly connected with their respective intermediate masses 128 (only one shown) (cf. 28 in FIG. 4) which are enlarged to the diameter of the paddles (cf. 10*b*, 10*c* in FIG. 4), for example, for force reduction. Such intermediate masses would have front and rear axially extending outer rims 128*a* (only one shown), respectively, on the radial insides of each of which would be axially spaced, e.g. side by side first and second ratchets 130, 132 of equal diameters. The first and second ratchets on each rim would be oppositely connecting to be respectively for clockwise and counterclockwise relative rotation connection. The first ratchet 130 would connect the hubs directly to the drive shaft 114 (cf. inner ratchets 30,30' in FIG. 4); and the second ratchets 132 would connect the drive shaft 114 to the hubs through a speed reducing, force increasing gear train 134, 136, 138, 142 (cf. periheral gear 34,34', small gears 36,36', large gears 38,38' and pinions 42,42' for the outer ratchets 32,32' in FIG. 4); but with an additional idler gear 138*a*** to achieve the relative directions of rotation of the first and second ratchets corresponding to those described above for the inner and outer ratchets. This mode would eliminate entirely the problem of the higher force on the inner ratchets.

Another embodiment includes another nozzle (not shown) at of the exemplary locations marked 186 in FIG. 3A in the third or, perhaps, fourth quadrant rotationally downstream of the ignition point but rotationally upstream of the point at which exhaust begins from the outlet in the fourth quadrant. This other nozzle would inject a material, probably a fluid, that gasifies (e.g. boils) at the temperature of the air/fuel explosion gases at the location of the other nozzle. Such other fluids may include $H_2O$ or $H_2O_2$, for example. The absorption of heat energy to gasify the other fluid will cool the explosion gases and, thus, the engine and the pressure of the gasified other fluid will add to the pressure of the air/fuel explosion gases that drive the engine. Such post ignition injection of a non-combustion other fluid may, therefore, further reduce fuel consumption and pollution for the same engine power as without the post ignition injection.

The inventors are also aware of another design for the gear train that provides the speed reduction and force increase necessary for the slow paddle rotation. This other design is, however, not presently preferred.

Still other embodiments and modes, particularly of ratchet design which is presently unsettled by the inventors, as will occur to others on the basis of the above description, are contemplated as within the scope of the following claims.

We claim:

1. A rotary internal combustion engine, comprising:

engine block means for defining a drum-shaped combustion chamber;

a rotatable drive shaft extending axially through the chamber;

first and second paddle and hub means substantially sealingly in the chamber and freely rotatable on the drive shaft, each of the paddle and hub means having first and second paddles that are fixed diametrically opposite each other with a hub therebetween, the hubs cooperating with each other so that the first and second paddles and hubs of the first paddle and hub means can also rotate relative to the first and second paddles and hub of the second paddle and hub means, the hub of the first and second paddle and hub means having end portions respectively extending from axially opposite ends of the chamber;

first and second gear train means for rotation by the respective end portions of the hubs, each of the first and second gear train means comprising (A) a first ratchet for rotationally connecting one of the hubs to the drive shaft in a first rotational direction and disconnecting the one of the hubs from the drive shaft in a second, opposite relative rotational direction and (B) a second ratchet with gear reduction means for rotationally connecting the drive shaft to the one of the hubs in the first rotational direction with a reduced rotational speed relative to a rotational speed of the rotational connection of the first ratchet and disconnecting the drive shaft from the one of the hubs in the second relative rotational direction, wherein the drive shaft and first and second paddle and hub means all rotate in the first rotational direction;

inlet means in a first quadrant of the chamber for admitting air into the chamber;

fuel means for admitting fuel into a third quadrant of the chamber, whereby to define an ignition point for an air/fuel explosion in the third quadrant; and outlet means in a fourth quadrant of the chamber for exhausting.

2. The rotary internal combustion engine according to claim 1, wherein the inlet means is an opening into the chamber.

3. The rotary internal combustion engine according to claim 1, wherein the fuel means comprises a nozzle in the third quadrant of the chamber.

4. The rotary internal combustion engine according to claim 2, wherein the fuel means comprises a nozzle in the third quadrant of the chamber.

5. The rotary internal combustion engine according to claim 1, wherein the outlet means is an opening into the chamber.

6. The rotary internal combustion engine according to claim 2, wherein the outlet means is an opening into the chamber.

7. The rotary internal combustion engine according to claim 3, wherein the outlet means is an opening into the chamber.

8. The rotary internal combustion engine according to claim 4, wherein the outlet means is an opening into the chamber.

9. The rotary internal combustion engine according to claim 1, wherein for each gear train means, the rotational connection of the one of the hubs to the propeller shaft comprises direct connection means for corresponding rotational speed of the one of the hubs and the propeller shaft in the first rotational direction.

10. The rotary internal combustion engine according to claim 2, wherein for each gear train means, the rotational connection of the one of the hubs to the drive shaft comprises direct connection means for corresponding rotational speed of the one of the hubs and the propeller shaft in the first rotational direction.

11. The rotary internal combustion engine according to claim 3, wherein for each gear train means, the rotational connection of the one of the hubs to the drive shaft comprises direct connection means for corresponding rotational speed of the one of the hubs and the propeller shaft in the first rotational direction.

12. The rotary internal combustion engine according to claim 5, wherein for each gear train means, the rotational connection of the one of the hubs to the drive shaft comprises direct connection means for corresponding rotational speed of the one of the hubs and the propeller shaft in the first rotational direction.

13. The rotary internal combustion engine according to claim 8, wherein for each gear train means, the rotational connection of the one of the hubs to the drive shaft comprises direct connection means for corresponding rotational speed of the one of the hubs and the propeller shaft in the first rotational direction.

14. The rotary internal combustion engine according to claim 1, wherein for each of the gear trains, the first and second ratchets are concentric.

15. The rotary internal combustion engine according to claim 9, wherein for each of the gear trains, the first and second ratchets are concentric.

16. The rotary internal combustion engine according to claim 13, wherein for each of the gear trains, the first and second ratchets are concentric.

17. The rotary internal combustion engine according to claim 1, and further comprising ignition means at the ignition point in the third quadrant of the chamber for igniting an air/fuel explosion.

18. The rotary internal combustion engine according to claim 13, and further comprising ignition means at the ignition point in the third quadrant of the chamber for igniting an air/fuel explosion.

19. The rotary internal combustion engine according to claim 1, wherein for each of the gear train means, the first and second ratchets are axially spaced from each other and of equal diameter.

20. The rotary internal combustion engine according to claim 1, and further comprising post ignition injection means for introducing a gasifying non-combustion material into the chamber rotationally downstream of the ignition point and upstream of the outlet means.

* * * * *